US009676396B2

(12) United States Patent
Fischer et al.

(10) Patent No.: US 9,676,396 B2
(45) Date of Patent: Jun. 13, 2017

(54) SYSTEM FOR MOVING VEHICLES ALONG TWO TRACKS

(75) Inventors: Florian Fischer, Wolfurt (AT); Bernhard Wohlgenannt, Lauterach (AT)

(73) Assignee: Innova Patent GmbH, Wolfurt (AT)

( * ) Notice: Subject to any disclaimer, the term of this patent is extended or adjusted under 35 U.S.C. 154(b) by 925 days.

(21) Appl. No.: 13/274,885

(22) Filed: Oct. 17, 2011

(65) Prior Publication Data

US 2012/0090497 A1 Apr. 19, 2012

(30) Foreign Application Priority Data

Oct. 18, 2010 (AT) ..... A 1728/2010

(51) Int. Cl.
*B61B 9/00* (2006.01)
*E01B 25/15* (2006.01)

(52) U.S. Cl.
CPC ..... *B61B 9/00* (2013.01); *E01B 25/15* (2013.01)

(58) Field of Classification Search
USPC ..... 246/385, 386, 287, 288, 289, 390, 452; 104/96, 100, 102, 103, 130.01, 130.06, 104/130.11, 173.1, 184, 186, 188
See application file for complete search history.

(56) References Cited

U.S. PATENT DOCUMENTS

| | | | | |
|---|---|---|---|---|
| 251,317 | A * | 12/1881 | Terry | 104/184 |
| 354,295 | A * | 12/1886 | Witherspoon | 104/184 |
| 820,406 | A * | 5/1906 | Flugan | 246/385 |
| 908,037 | A * | 12/1908 | Robinson | 246/386 |
| 6,422,519 | B1 * | 7/2002 | Braatz | 246/258 |

FOREIGN PATENT DOCUMENTS

| | | |
|---|---|---|
| DE | 3237913 C1 | 3/1984 |
| EP | 1193153 A1 | 4/2002 |
| FR | 2658772 A1 | 8/1991 |

* cited by examiner

*Primary Examiner* — Mark Le
(74) *Attorney, Agent, or Firm* — Laurence A. Greenberg; Werner H. Stemer; Ralph E. Locher

(57) ABSTRACT

A system for moving vehicles along two tracks that are in each case formed by two guides, in particular rails. The vehicles are moved by endless conveying cables to which the vehicles may be coupled. The two tracks have a switch in the regions of the end stations and where appropriate along the course, by way of which they are brought together. The switch has four guides which are located next to one another. The middle two guides, which are rigidly connected to one another, are pivotal about a first axis and the outer two guides, which are connected to one another in an articulated manner, are pivotal about two further axes that are spaced from one another. The switch that is formed by the four guides can thus be pivoted out of a first position into a second position.

8 Claims, 2 Drawing Sheets

SYSTEM FOR MOVING VEHICLES ALONG TWO TRACKS

CROSS-REFERENCE TO RELATED APPLICATION

This application claims the priority, under 35 U.S.C. §119, of Austrian patent application A 1728/2010, filed Oct. 18, 2010; the prior application is herewith incorporated by reference in its entirety.

BACKGROUND OF THE INVENTION

Field of the Invention

The present invention relates to a system for moving vehicles along two tracks that are in each case formed by two guides, in particular rails, by means of at least two conveying cables which are moved in a loop and to which the vehicles may be coupled, as a result of which they are moved along the two tracks, wherein the two tracks are constructed to have, in the regions of the end stations and where appropriate along the course, a switch by means of which they are brought together.

In systems of this kind, known for example from European patent EP 1 193 153 B1 and from French published patent application FR 2 658 772 A1, two tracks are provided, along which a plurality of vehicles are moved back and forth between two end stations by means of conveying cables. The two tracks are brought together at the two end stations. As a result of this, at the end stations coupling of the vehicles may be transferred from the conveying cable that is associated with a first track to the conveying cable that is associated with a second track and that moves in the opposite direction, and the vehicles may be moved out of the end station along the second track. Between the two end stations, the two tracks run either approximately parallel to one another or the tracks are similarly brought together in certain portions, although in this case the tracks are located next to one another between these portions, as a result of which passing loops are formed in which vehicles moving in opposite directions can move past each other.

In systems of this kind, switches are provided in the end stations and where appropriate also between the end stations at those locations in which the two tracks are brought together or in which a single track branches into two tracks.

Where these switches are concerned, it should be noted that switches known from railway technology, which are constructed to have switch rails, are disadvantageous in that they cause kinks in the line of the tracks, and these kinks have the effect of causing jolts during movement of the vehicles when the latter come up against them, which has to be taken into account on the one hand when the vehicles are designed, with respect to their shock absorption, and on the other in respect of the speed at which the vehicles are moved.

Since this problem arises in railways too, it is known for example from German patent DE 3237913 C1 to construct switches such that two lengths of track are provided and may be pushed, in the region of the branch, between the mutually adjoining tracks, as a result of which one of these two lengths of track forms a first join and the second length of track forms the second join. The application of this known technical solution to a system having vehicles that are moved by conveying cables is not possible, however, since the two conveying cables are also located in the region of the switches, as a result of which pushing in two lengths of track in a manner supposed to perform the function of a switch is not possible or is very complicated from a constructional point of view.

SUMMARY OF THE INVENTION

It is accordingly an object of the invention to provide a system for moving vehicles along two tracks which overcome the above-mentioned disadvantages of the heretofore-known devices and methods of this general type and which provides for an improved such switch in a system with vehicles that are moved by conveying cables.

With the foregoing and other objects in view there is provided, in accordance with the invention, a system for moving vehicles, comprising:

a plurality of tracks each formed by two guides (e.g., rails);

at least two conveying cables (e.g., endless circulating cables) extending along the tracks for coupling the vehicles thereto and moving the vehicles along the tracks;

at least one switch disposed in the tracks at terminal stations or along a course of the tracks, the switch having four guides disposed next to one another, the four guides including two middle guides rigidly connected to one another and pivotally mounted about a first axis, and including two outer guides, connected to one another in an articulated manner, and pivotally mounted about two mutually spaced-apart further axes, wherein the switch that is formed by the four guides is pivotal out of a first position into a second position.

In other words, the objects of the invention are achieved in that the switch has four guides which are located next to one another, and in that the middle two guides, which are rigidly connected to one another, are pivotal about a first axis and the outer two guides, which are connected to one another in articulated manner, are pivotal about two further axes that are spaced apart from one another, as a result of which the switch that is formed by four guides may be pivoted out of a first position into a second position.

Preferably, the inner two guides of the switch are rigidly connected to a servo lever which is mounted, at an end outside the two guides, to be pivotal about a fixed axis, and to which a servo piston is articulated, with the latter being able to move the inner two guides into one of the two pivotal positions. Furthermore and preferably, the two guides on the outside of the switch, which are connected to one another in an articulated manner by way of a transverse strut, are pivotal by means of a further servo piston about further axes which are each arranged to the side and outside. Moreover and preferably, the further servo piston is articulated to the strut which connects in an articulated manner the two guides arranged on the outside.

According to a further preferred embodiment, the guides of the switch are each constructed to have at least one movable support which is movable along a curved path, and furthermore the guides are each constructed to have at least one support with which a counter-bearing is associated in both positions of the switch.

Other features which are considered as characteristic for the invention are set forth in the appended claims.

Although the invention is illustrated and described herein as embodied in a system for moving vehicles along two tracks, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INTENTION

Figure 1:
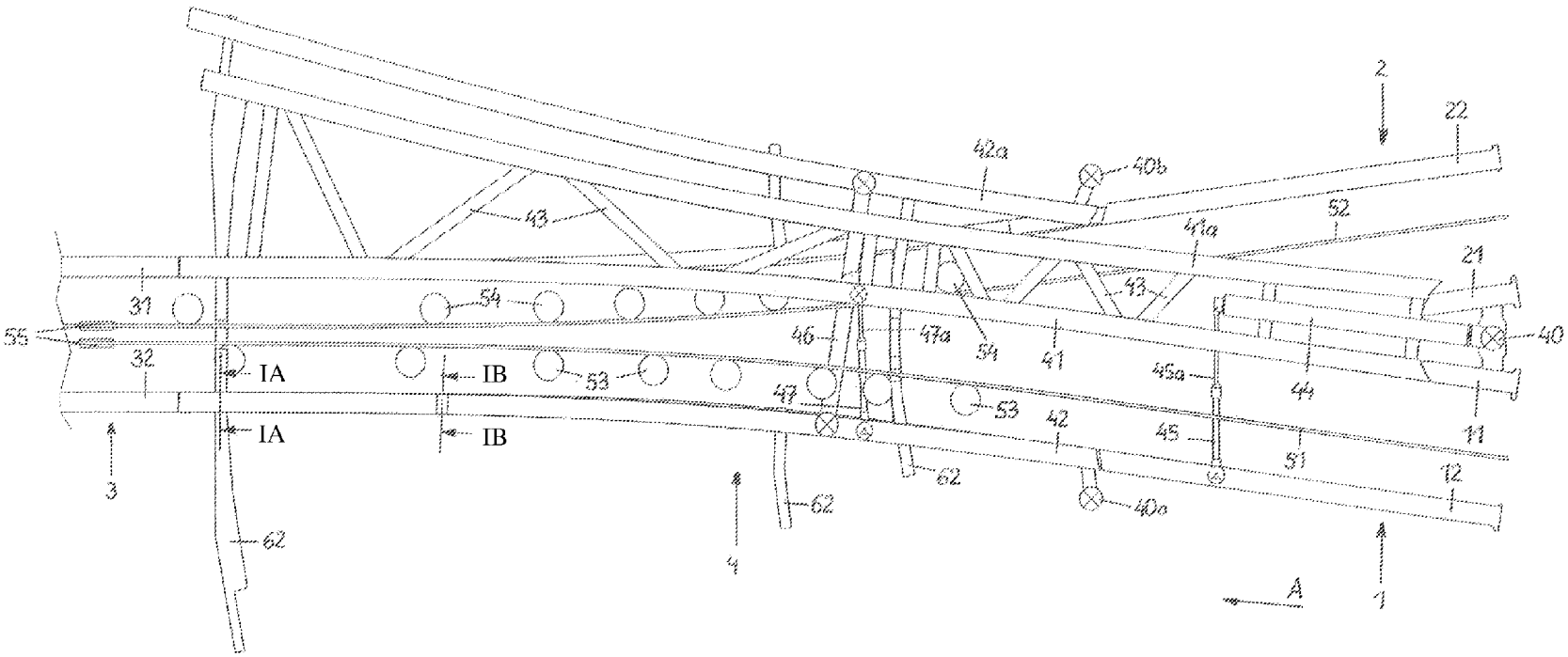
FIG. 1 is a plan view of a switch which is located in a system for moving vehicles by way of two conveying cables, in a first position of the switch.

Referring now to the figures of the drawing in detail and first, particularly, to FIG. 1 thereof, there is shown a system for moving vehicles having a first track 1, which is formed by two guides 11 and 12, in particular rails, and a second track 2, which is formed by two guides 21 and 22, in particular rails. Furthermore, a third track 3 is provided, which is formed by two guides 31 and 32, in particular rails, and which is joined to the first track 1 or the second track 2 by way of a switch 4, which is formed by four guides 41, 41*a*, 42 and 42*a* which are located next to one another, in particular rails.

In FIG. 1 the switch 4 connects to first track 1 to the third track 3.

The vehicles are moved along the tracks 1, 2 and 3 by means of two continuous conveying cables 51 and 52 which run along the tracks 1, 2 and 3, wherein they are guided by way of deflection rolls 53 and 54 or carrying rolls 55.

Figure 2:
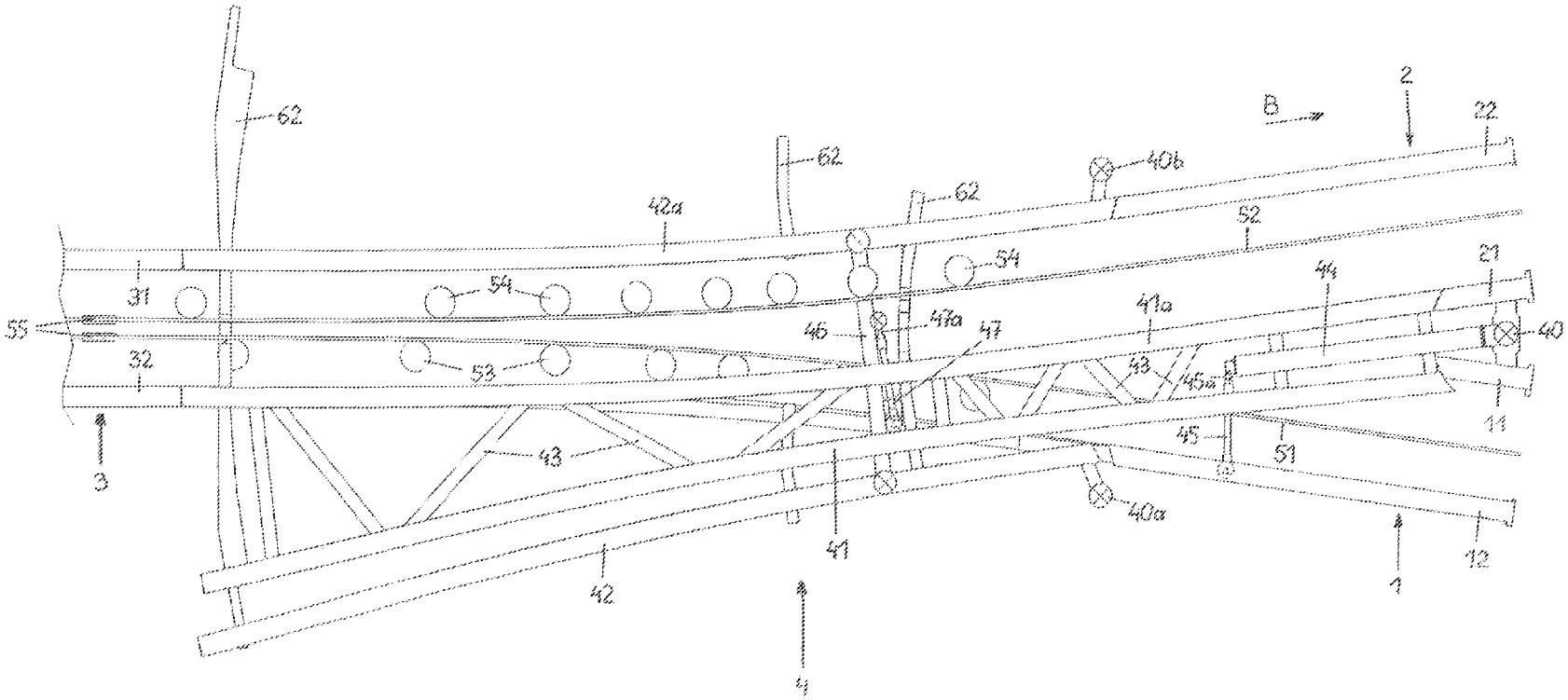
FIG. 2 is a plan view of the switch illustrated in FIG. 1 in a second position of the switch.

The inner two guides 41 and 41*a* of the switch 4 are rigidly connected to one another by way of a plurality of struts 43. Furthermore provided is a servo lever 44, which is pivotal about a fixed axis 40 by means of a servo cylinder 45 and a servo rod 45*a* and which is rigidly connected to the guides 41 and 41*a*. By means of the servo cylinder 45, the guides 41 and 41*a* are pivotal about the axis 40 out of a first position, which is illustrated in FIG. 1, into a second position, which is illustrated in FIG. 2.

The outer two guides 42 and 42*a* are connected to one another by means of a strut 46 which is pivotally articulated thereto. Furthermore, the outer two guides 42 and 42*a* are movable by means of a servo cylinder 47 and servo rod 47*a*, which is articulated to the strut 46, about two further fixed axes 40*a* and 40*b*, out of a first position, which is illustrated in FIG. 1, into a second position, which is illustrated in FIG. 2.

Figure 1B:
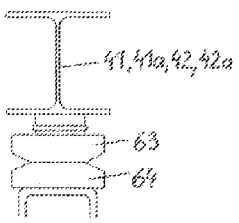
FIG. 1B is a section along the plane IB-IB in FIG. 1.
Figure 1A:
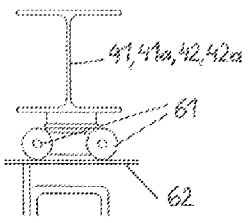
FIG. 1A is a section taken along the plane IA-IA in FIG. 1.

The guides 41, 41, 42 and 42*a* are constructed to have a plurality of support devices 6, which are illustrated in FIG. 1A and are formed by support rolls 61 that are movable along paths 62 that run transversely in relation to the guides 41, 41*a*, 42 and 42*a*. Furthermore, the guides 41, 41*a*, 42 and 42*a* are constructed to have a plurality of support elements 63, which are illustrated in FIG. 1B and with which fixed counter-elements 64 are associated.

In the first position of the switch 4, vehicles that are coupled to the conveying cable 51, and are hence moved thereby in the direction of the arrow A, pass along the guides 11 and 12, over the guides 41 and 42 and onto the guides 31 and 32. In the end station, coupling of the vehicles is transferred from the first conveying cable 51 onto the conveying cable 52, which is moved in the opposite direction, as a result of which, once the switch 4 has been operated, they are moved in the direction of the arrow B, over the guides 41*a* and 42*a* and onto the adjoining guides 21 and 22 of the second track 2.

Because the guides 41, 41*a*, 42 and 42*a* of the switch 4 adjoin each of the guides 11 and 12 of the first track 1, the guides 21 and 22 of the second track 2 and the guides 31 and 32 of the third track 3, directly and with no change in the curvature, when the vehicles run over the switch 4 any jolting is avoided, as a result of which the travel properties of the vehicles are significantly improved and their speeds of travel can be increased. Because, furthermore, the guides 41, 41*a*, 42 and 42*a* of the switch 4 are pivoted from the first position into the second position, collisions between the guides 41 to 44 and the conveying cables 51 and 52 are avoided.

The invention claimed is:

1. A system for moving vehicles, comprising:

a plurality of tracks each formed by two guides for supporting the vehicles;

at least two conveying cables extending along said tracks below a level of said guides for coupling the vehicles thereto and moving the vehicles along said tracks;

at least one switch disposed in said tracks at terminal stations or along a course of said tracks, said switch having four guides disposed next to one another, said four guides including two middle guides rigidly connected to one another and pivotally mounted about a first axis, and including two outer guides, connected to one another in an articulated manner, and pivotally mounted about two mutually spaced-apart further axes, wherein said switch that is formed by said four guides is pivotal out of a first position into a second position.

2. The system according to claim 1, wherein said guides of said tracks are rails.

3. The system according to claim 1, wherein said conveying cables are endlessly circulating conveying cables.

4. The system according to claim 1, which further comprises a servo lever connected to said two inner guides of said switch, and pivotally mounted at an end outside said two guides about a fixed axis, and a servo piston articulated to said servo lever and configured to move said two inner guides into one of the two pivotal positions thereof.

5. The system according to claim 4, wherein said two outer guides on the outside of said switch are connected to one another in an articulated manner by way of a transverse strut, and which comprises a further servo piston for pivoting said two outer guides about further axes each arranged to the side and outside.

6. The system according to claim 5, wherein said further servo piston is articulated to said strut connecting said two outer guides in an articulated manner.

7. The system according to claim 1, wherein said guides of said switch are each configured with at least one movable support that is movable along a curved path.

8. The system according to claim 1, wherein said guides are each constructed to have at least one support with which a counter-bearing is associated in first and second positions of said switch.

* * * * *